US006544030B1

(12) United States Patent
Evers

(10) Patent No.: US 6,544,030 B1
(45) Date of Patent: Apr. 8, 2003

(54) LIGHTER AND BOTTLE OPENER COMBINATION

(76) Inventor: Jason A. Evers, 877 W. Wilson St., Costa Mesa, CA (US) 92627

( * ) Notice: Subject to any disclaimer, the term of this patent is extended or adjusted under 35 U.S.C. 154(b) by 13 days.

(21) Appl. No.: 09/822,394

(22) Filed: Mar. 30, 2001

(51) Int. Cl.[7] ..... F23Q 2/32
(52) U.S. Cl. ..... 431/253; 7/151; 81/3.55
(58) Field of Search ..... 431/253; 7/151; 81/3.4, 3.44, 3.55; D8/18

(56) References Cited

U.S. PATENT DOCUMENTS

| | | | | |
|---|---|---|---|---|
| 4,373,223 | A | | 2/1983 | Miller |
| 4,560,344 | A | | 12/1985 | Kietaibl |
| 4,569,653 | A | | 2/1986 | Becker et al. |
| 4,642,827 | A | | 2/1987 | Karuzas |
| 4,854,856 | A | | 8/1989 | Steiger, Jr. et al. |
| 5,169,305 | A | * | 12/1992 | Kee ..... 431/253 |
| D374,740 | S | | 10/1996 | Seaman et al. |

FOREIGN PATENT DOCUMENTS

| | | | |
|---|---|---|---|
| DE | 3240377 A1 | * | 5/1984 |
| JP | 2001-139030 A | * | 5/2001 |

* cited by examiner

*Primary Examiner*—Sara Clarke

(57) ABSTRACT

A lighter and bottle opener combination for supplying a user of a lighter with a convenient bottle opener. The lighter and bottle opener combination includes a housing having a first end, a second end and a peripheral wall extending between the first and second ends. The housing has a chamber therein. A fuel is located in the chamber. A lighting assembly for igniting the fuel and producing a flame is in communication with the chamber. The lighting assembly is attached to the second end of the housing. The first end of the housing has an arcuate slot therein defining a bottle cap engaging portion of the housing. The slot may be positioned against a bottle and the housing biased against a bottle cap on the bottle such that the bottle cap is removed from the bottle.

8 Claims, 2 Drawing Sheets

LIGHTER AND BOTTLE OPENER COMBINATION

BACKGROUND OF THE INVENTION

1. Field of the Invention

The present invention relates to bottle opening devices and more particularly pertains to a new lighter and bottle opener combination for supplying a user of a lighter with a convenient bottle opener.

2. Description of the Prior Art

The use of bottle opening devices is known in the prior art. More specifically, bottle opening devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,373,223; 4,854,856; 4,642,827; 4,560,344; 4,569,653; and U.S. Des. Patent No. 374,740.

While these devices fulfill their respective, particular objectives and requirements, the aforementioned patents do not disclose a new lighter and bottle opener combination. The inventive device includes a housing having a first end, a second end and a peripheral wall extending between the first and second ends. The housing has a chamber therein. A fuel is located in the chamber. A lighting assembly for igniting the fuel and producing a flame is in communication with the chamber. The lighting assembly is attached to the second end of the housing. The first end of the housing has an arcuate slot therein defining a bottle cap engaging portion of the housing. The slot may be positioned against a bottle and the housing biased against a bottle cap on the bottle such that the bottle cap is removed from the bottle.

In these respects, the lighter and bottle opener combination according to the present invention substantially departs from the conventional concepts and designs of the prior art, and in so doing provides an apparatus primarily developed for the purpose of supplying a user of a lighter with a convenient bottle opener.

SUMMARY OF THE INVENTION

In view of the foregoing disadvantages inherent in the known types of bottle opening devices now present in the prior art, the present invention provides a new lighter and bottle opener combination construction wherein the same can be utilized for supplying a user of a lighter with a convenient bottle opener.

The general purpose of the present invention, which will be described subsequently in greater detail, is to provide a new lighter and bottle opener combination apparatus and method which has many of the advantages of the bottle opening devices mentioned heretofore and many novel features that result in a new lighter and bottle opener combination which is not anticipated, rendered obvious, suggested, or even implied by any of the prior art bottle opening devices, either alone or in any combination thereof.

To attain this, the present invention generally comprises a housing having a first end, a second end and a peripheral wall extending between the first and second ends. The housing has a chamber therein. A fuel is located in the chamber. A lighting assembly for igniting the fuel and producing a flame is in communication with the chamber. The lighting assembly is attached to the second end of the housing. The first end of the housing has an arcuate slot therein defining a bottle cap engaging portion of the housing. The slot may be positioned against a bottle and the housing biased against a bottle cap on the bottle such that the bottle cap is removed from the bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lighter and bottle opener combination apparatus and method which has many of the advantages of the bottle opening devices mentioned heretofore and many novel features that result in a new lighter and bottle opener combination which is not anticipated, rendered obvious, suggested, or even implied by any of the prior art bottle opening devices, either alone or in any combination thereof.

It is another object of the present invention to provide a new lighter and bottle opener combination which may be easily and efficiently manufactured and marketed.

It is a further object of the present invention to provide a new lighter and bottle opener combination which is of a durable and reliable construction.

An even further object of the present invention is to provide a new lighter and bottle opener combination which is susceptible of a low cost of manufacture with regard to both materials and labor, and which accordingly is then susceptible of low prices of sale to the consuming public, thereby making such lighter and bottle opener combination economically available to the buying public.

Still yet another object of the present invention is to provide a new lighter and bottle opener combination which provides in the apparatuses and methods of the prior art some of the advantages thereof, while simultaneously overcoming some of the disadvantages normally associated therewith.

Still another object of the present invention is to provide a new lighter and bottle opener combination for supplying a user of a lighter with a convenient bottle opener.

Yet another object of the present invention is to provide a new lighter and bottle opener combination which includes a housing having a first end, a second end and a peripheral wall extending between the first and second ends. The housing has a chamber therein. A fuel is located in the chamber. A lighting assembly for igniting the fuel and producing a flame is in communication with the chamber. The lighting assembly is attached to the second end of the housing. The first end of the housing has an arcuate slot therein defining a bottle cap engaging portion of the housing. The slot may be positioned against a bottle and the housing biased against a bottle cap on the bottle such that the bottle cap is removed from the bottle.

Still yet another object of the present invention is to provide a new lighter and bottle opener combination that allows a user to open bottles with their lighters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
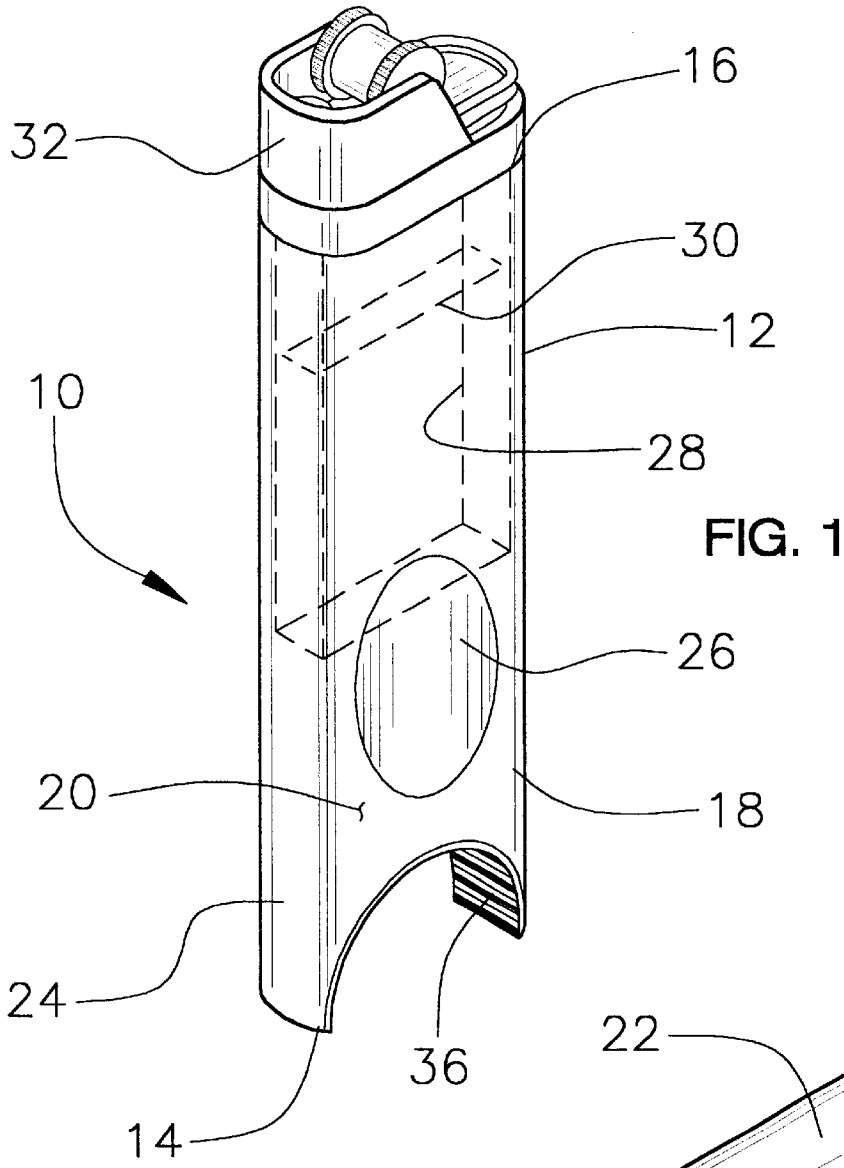
FIG. 1 is a schematic perspective view of a new lighter and bottle opener combination according to the present invention.
Figure 2:
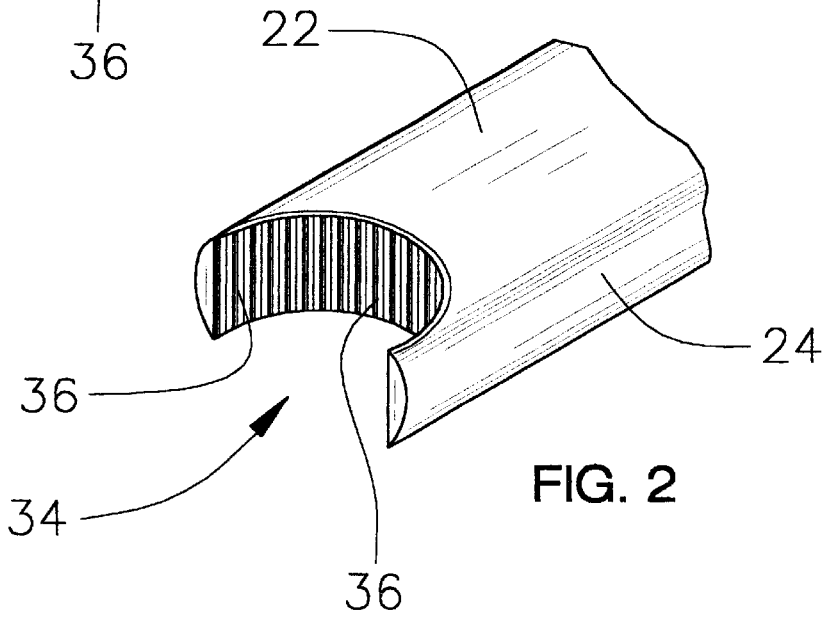
FIG. 2 is a schematic bottom perspective view of the present invention.
Figure 3:
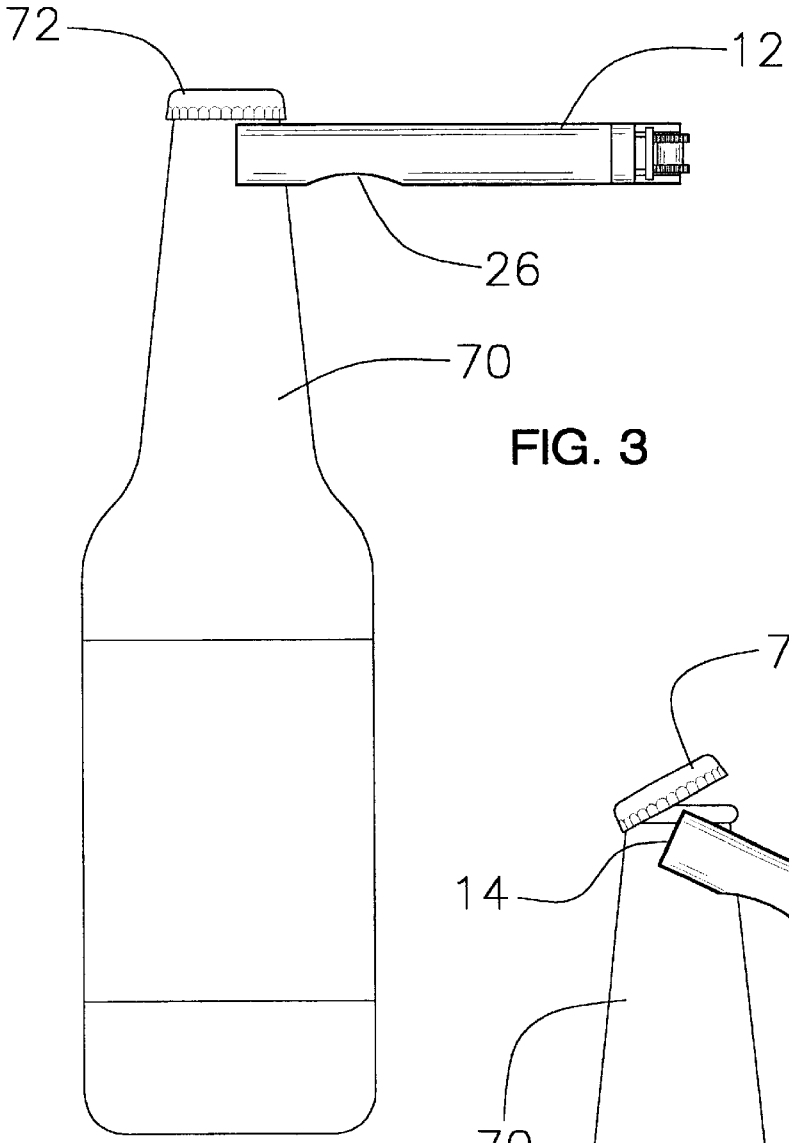
FIG. 3 is a schematic in-use side view of the present invention.
Figure 4:
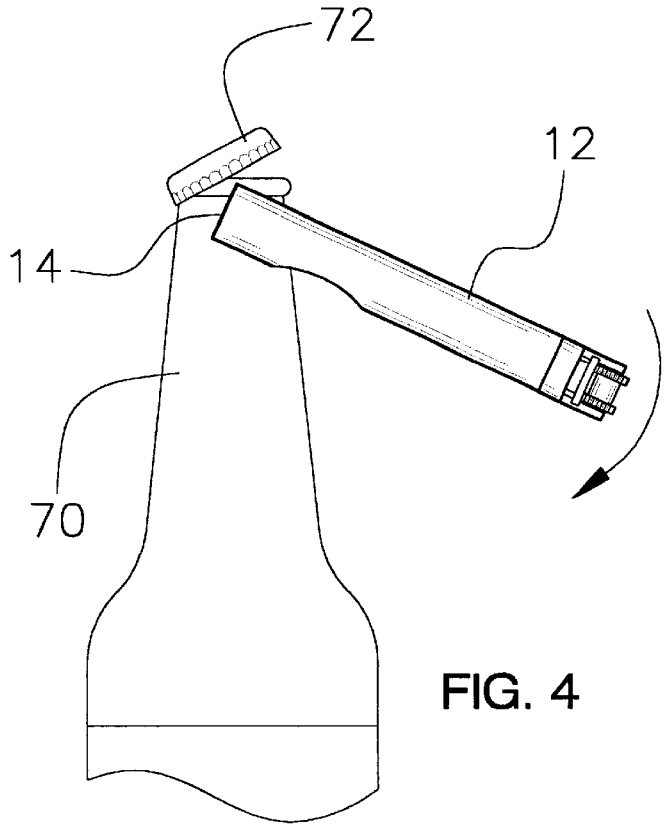
FIG. 4 is a schematic in-use side view of the present invention.

With reference now to the drawings, and in particular to FIGS. 1 through 4 thereof, a new lighter and bottle opener combination embodying the principles and concepts of the present invention and generally designated by the reference numeral 10 will be described.

As best illustrated in FIGS. 1 through 4, the lighter and bottle opener combination 10 generally comprises a housing 12 having a first end 14, a second end 16 and a peripheral wall 18 extending between the first 14 and second 16 ends. The peripheral wall 18 includes a front wall 20, a back wall 22 and a pair of lateral side walls 24. The front wall 20 has an indentation 26 therein located nearer the first end 14 than the second end 16. The indentation 26 has an oval shape. The housing 12 has a chamber 28 therein. The housing 12 is preferably comprised of a metallic material or a rigid plastic.

A fuel 30 is located in the chamber 28. The fuel 30 preferably being butane or other conventional fuels used in cigarette lighters.

A lighting assembly 32 ignites the fuel 30 and produces a flame. The lighting assembly 32 is in communication with the chamber 28. The lighting assembly 32 is attached to the second end 16 of the housing 12. The lighting assembly 32 and chamber 28 combination form the basis for a conventional cigarette lighter.

The first end 14 of the housing 12 has an arcuate slot 34 therein that defines a bottle cap engaging portion of the housing 12. The slot 34 extends through the front 20 and back 22 walls of the housing 12 and arcs toward the second end 16 of the housing 12. The slot 34 extends toward the lateral sides 24 and generally has a semi-circular shape. The slot 34 has an interior wall having a plurality of ribs 36 aligned in a parallel orientation and extending from the front wall 20 to the back wall 22 for gripping of a bottle cap 72.

In use, the slot 34 may be positioned against a bottle 70 and the housing 12 abutting a bottle cap 72 coupled to the bottle 70 with the indentation 26 facing downward away from the bottle cap 72. The user places their finger against the indentation 26 and the bottle 70 to act as a fulcrum. The second end 16 of the housing 12 is moved downward to bias the first end 14 against the bottle cap 72 such that the bottle cap 72 is dislodged from the bottle 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighter and bottle opener combination device for removing a bottle cap from a bottle, said device comprising:

a housing having a first end, a second end and a peripheral wall extending between said first and second ends, said housing having a chamber therein;

a fuel being located in said chamber;

a lighting assembly for igniting said fuel and producing a flame being in communication with said chamber, said lighting assembly being attached to said second end of said housing;

said first end of said housing having an arcuate slot therein and defining a bottle cap engaging portion of said housing;

wherein said slot may be positioned against said bottle and said housing biased against said bottle cap such that said bottle cap is removed from said bottles wherein said peripheral wall includes a front wall, a back wall and a pair of lateral side walls, said front wall having an indentation therein, said indentation being located nearer said first end than said second end; and wherein said indentation has an oval shape.

2. The lighter and bottle opener combination device as in claim 1, wherein said slot extends through front and back walls of said housing and arcing toward said second end of said housing.

3. The lighter and bottle opener combination device as in claim 2, wherein said slot extends toward said lateral sides and generally has a semi-circular shape.

4. The lighter and bottle opener combination device as in claim 2, wherein said slot has an interior wall having a plurality of ribs aligned in a parallel orientation and extending from said front wall to said back wall.

5. The lighter and bottle opener combination device as in claim 2, further comprising:

said slot extending through said front and back walls of said housing and arcing toward said second end of said housing, said slot extending toward said lateral sides and generally having a semi-circular shape, said slot having an interior wall having a plurality of ribs aligned in a parallel orientation and extending from said front wall to said back wall.

6. A lighter and bottle opener combination device for removing a bottle cap from a bottle, said device comprising:

a housing having a first end, a second end and a peripheral wall extending between said first and second ends, said housing having a chamber therein;

a fuel being located in said chamber;

a lighting assembly for igniting said fuel and producing a flame being in communication with said chamber, said lighting assembly being attached to said second end of said housing;

said first end of said housing having an arcuate slot therein and defining a bottle cap engaging portion of said housing;

wherein said slot may be positioned against said bottle and said housing biased against said bottle cap such that said bottle cap is removed from said bottle;

wherein said peripheral wall includes a front wall, a back wall and a pair of lateral side walls, said slot extending through front and back walls of said housing and arcing toward said second end of said housing; and wherein said slot extends toward said lateral sides and generally has a semi-circular shape.

7. The lighter and bottle opener combination device as in claim 6, wherein said slot has an interior wall having a plurality of ribs aligned in a parallel orientation and extending from said front wall to said back wall.

8. A lighter and bottle opener combination device for removing a bottle cap from a bottle, said device comprising:

a housing having a first end, a second end and a peripheral wall extending between said first and second ends, said housing having a chamber therein;

a fuel being located in said chamber;

a lighting assembly for igniting said fuel and producing a flame being in communication with said chamber, said lighting assembly being attached to said second end of said housing;

said first end of said housing having an arcuate slot therein and defining a bottle cap engaging portion of said housing;

wherein said slot may be positioned against said bottle and said housing biased against said bottle cap such that said bottle cap is removed from said bottle;

wherein said peripheral wall includes a front wall, a back wall and a pair of lateral side walls, said slot extending through front and back walls of said housing and arcing toward said second end of said housing; and wherein said slot has an interior wall having a plurality of ribs aligned in a parallel orientation and extending from said front wall to said back wall.

* * * * *